United States Patent [19]

Buss et al.

[11] Patent Number: 4,507,075

[45] Date of Patent: Mar. 26, 1985

[54] COMBUSTION DEVICE

[75] Inventors: Dietrich Buss, Eschweiler; Klaus Brücher; Wilhelm Wenz, both of Hückelhoven, all of Fed. Rep. of Germany

[73] Assignee: Gewerkschaft Sophia-Jacoba, Hückelhoven, Fed. Rep. of Germany

[21] Appl. No.: 579,483

[22] Filed: Feb. 13, 1984

[30] Foreign Application Priority Data

Dec. 13, 1983 [EP] European Pat. Off. ..... 83112521.6

[51] Int. Cl.[3] ..... F23D 15/02

[52] U.S. Cl. ..... 431/115; 431/3; 431/173; 431/182; 431/352; 60/750; 110/265

[58] Field of Search ..... 431/9, 173, 182, 183, 431/115; 431/351, 352; 110/264, 265; 60/737, 738, 750

[56] References Cited

U.S. PATENT DOCUMENTS

| | | | |
|---|---|---|---|
| 3,579,983 | 5/1971 | Carvel et al. | 431/352 |
| 4,255,122 | 3/1981 | Alpkvist et al. | 60/737 |
| 4,389,185 | 6/1983 | Alpkvist | 60/738 |

*Primary Examiner*—Carroll B. Dority, Jr.
*Attorney, Agent, or Firm*—Becker & Becker, Inc.

[57] ABSTRACT

A combustion device, especially for slow-to-react pulverized coal or coal dust. The inventive device includes the following combination of features: a blow lance, which supplies the coal dust and extends axially through a cylindrical or conical burner tube, and a twist device for the combustion air at the front end of the burner tube; a cap at the free discharge end of the blow lance for reversing the direction of flow of the coal dust outside the lance; a cylindrical or conical accelerator chamber which is disposed after the burner tube in the axial direction of the latter and which has a diameter at the transition from the burner tube to this chamber which is greater than the diameter of the burner tube at this transition and forms an enlargement and a shoulder; and a plurality of nozzles which are tangentially disposed in a plurality of cross-sectional planes arranged one after the other in the longitudinal direction of the accelerator chamber; these nozzles, independently of one another, supply to the enlargement of the accelerator chamber gas or air while forming in this enlargement a twist flow.

5 Claims, 3 Drawing Figures

Fig. 2
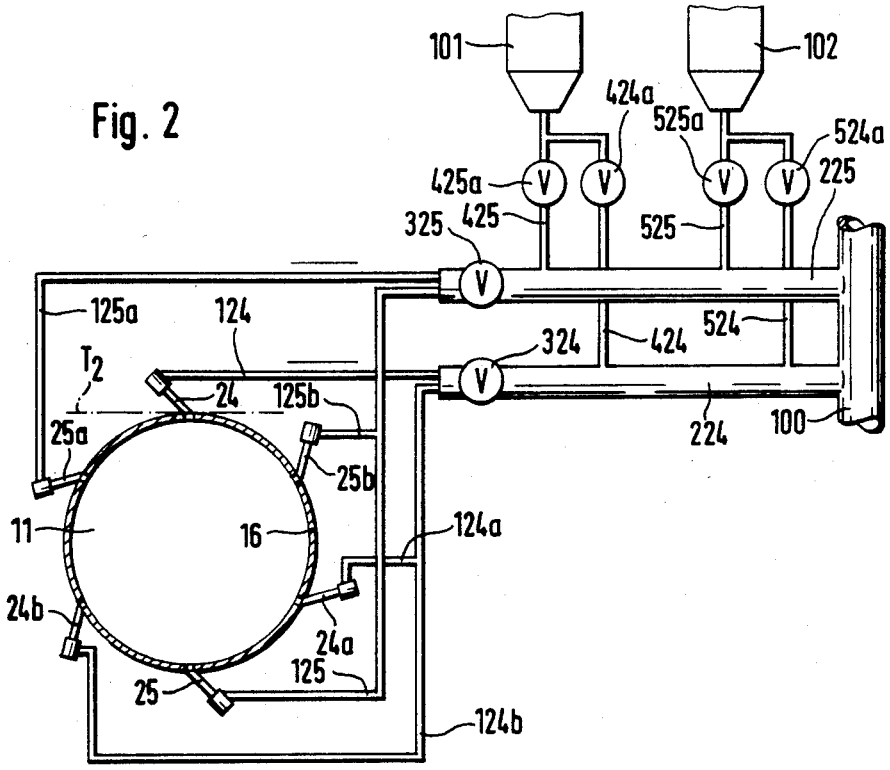
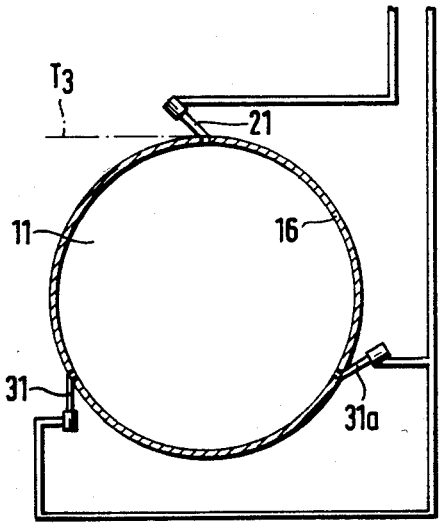
Fig. 3

COMBUSTION DEVICE

FIELD OF THE INVENTION

The present invention relates to a combustion device, especially for slow-to-react pulverized coal or coal dust.

It is an object of the present invention to increase the degree of combustion, i.e. the proportion of burn material in the ash, and thus to increase the efficiency, but also to be able to utilize the ash produced for another purpose, such as in the cement industry. Furthermore, the structural length of the inventive device should be shorter than that of heretofore known devices. The dust and ash produced should be easy to collect and remove from the device. It is a further object of the present invention to be able to achieve an effective desulfurization and/or other liberation of the flue gases from undesirable gases and constituents.

BRIEF DESCRIPTION OF THE DRAWINGS

These and other objects and advantages of the present invention will appear more clearly from the following specification in conjunction with the accompanying drawings, in which:

FIG. 2 is a section taken along the line II—II of FIG. 1 and also shows the connecting lines of the nozzles of the accelerator chamber; and FIG. 3 is a section taken along line III—III of FIG. 1, and also shows the connecting lines of the nozzles of the accelerator chamber.

SUMMARY OF THE INVENTION

Figure 1:
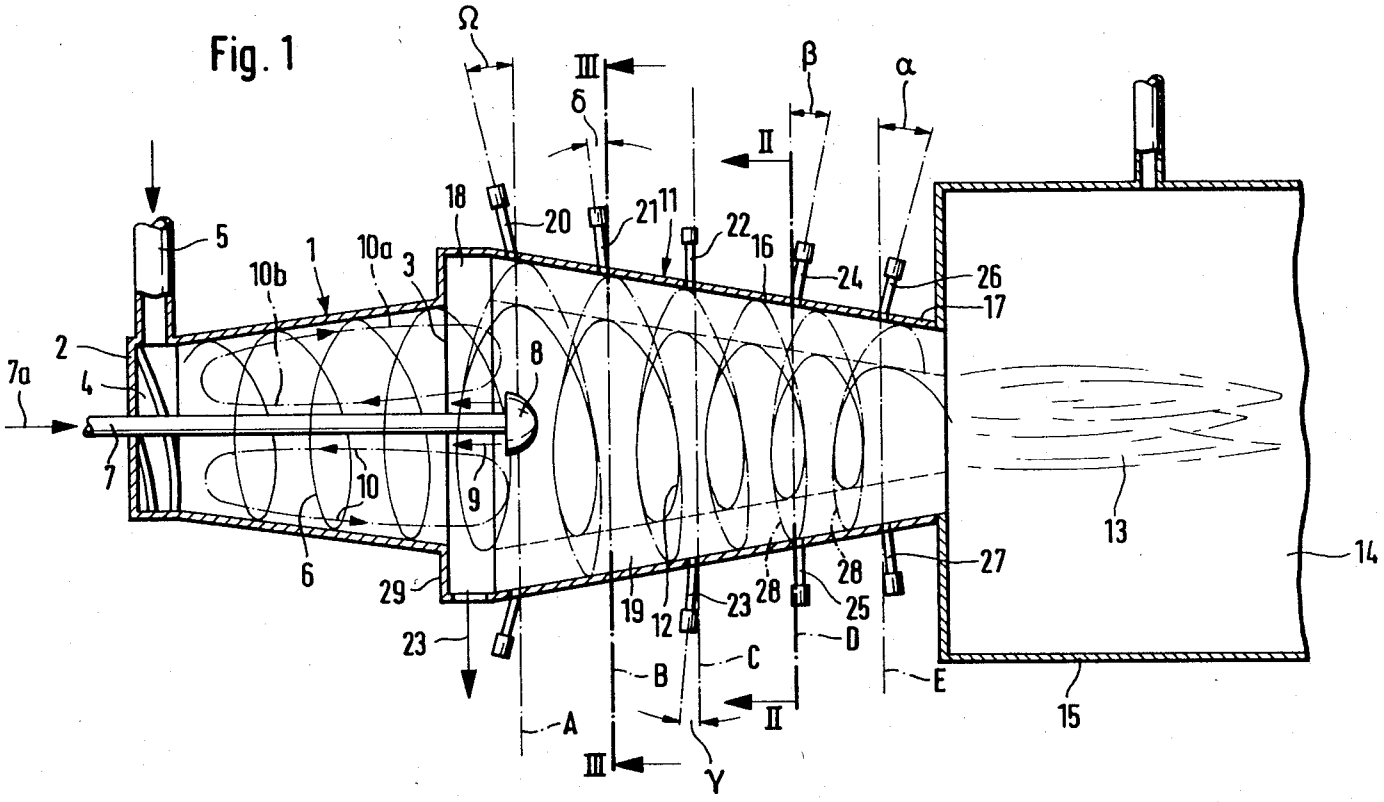
FIG. 1 is a longitudinal section through the burner tube and accelerator chamber of one inventive embodiment of the inventive device.

The combustion device of the present invention is characterized primarily by the combination of the following features:

(a) a blow lance which supplies the cool dust and extends axially through a cylindrical or conical burner tube, and a twist means located at the front end of the burner tube for the combustion air;

(b) a cap disposed on the free discharge end of the blow lance for reversing the direction of flow of the coal dust outside the lance;

(c) a cylindrical or conical accelerator chamber which is disposed after the burner tube when viewed in the axial direction of the latter, and which has a diameter at the transition from the burner tube to this chamber which is greater than the diameter of the burner tube at this transition and forms an enlargement and a shoulder; and (d) a plurality of nozzles which are tangentially disposed in a plurality of cross-sectional planes which are successively arranged when viewed in the longitudinal direction of the accelerator chamber; these nozzles independently supply to the enlargement of the accelerator chamber gas or air while forming in this enlargement a twist flow.

Pursuant to further improvements and specific embodiments of the present invention, gas or air supply lines and conduits may be provided to the nozzles, and may be provided with volume control valves for individual, groups of, or all of the nozzles of a given cross-sectional plane. The nozzles of the cross-sectional planes may also be connected with tanks for additives via lines which are provided with quantity control valves. The gas or air nozzles may be fixed or adjustably disposed in the wall of the accelerator chamber at tangential angles and/or angles relative to the cross-sectional planes, which angles change from one plane to the next, or even within the same plane. At least one tangential ash removal passage may be provided on the shoulder between the burner tube and the accelerator chamber.

DESCRIPTION OF PRIOR DISCLOSURES

U.S. Pat. No. 4,128,388 discloses a gas or oil burner; the side wall of the burner chamber is provided with orifices and is surrounded by a shell-like chamber from which air can enter the burner chamber through the orifices. The air path is selected in such a way that the air is first conducted along the inner wall of the burner chamber axially relative to the burner, where it is then reversed by 180° and subsequently made to flow in the axial direction of the burner chamber, possibly accompanied by the generation of turbulance. This heretofore known device is intended to achieve a thorough mixing of the air with the liquid fuel or with the gas. However, the object of the present invention, as previously stated, is neither intended nor can it be achieved with this heretofore known device. Not only can a yield of ashes not be achieved therewith, nor can the effort to achieve a high combustion of the solid fuel.

To separate dust from air flows, rotary current dust-removal equipment is known according to which an inner air flow to which has been imparted a twist or rotary movement, has superimposed thereover a similar yet oppositely directed air flow, so that with an upright dust-removal apparatus, the clean air can escape upwardly in the vicinity of the axis of the dust-removal apparatus, while the dust which is moved outwardly due to the centrifugal forces can be conveyed downwardly as a result of the additional helical air flow and the centrifugal force, and can be withdrawn from the bottom of the apparatus (VDI-B erichte Nr. 363, 1980, pages 61–68). Attempts were made to try to apply this principle of the rotary flow dust-removal apparatus to a pulverized coal burner (VDI-B erichte 146/1970). Alone, these attempts did not lead to a satisfactory result. Not until the principle of the rotary flow dust-removal apparatus was combined with a burner tube (disclosed by German Offenlegungsschrift No. 25 27 618) having an axial coal dust supply lance and a cap which reverses the direction of flow in the blow lance externally of the latter, was some success achieved. However, these results did not live up to the desired expectations. During operation, varying results were obtained with regard to sharply reducing the content of unburned material in the ash. It was discovered that at the beginning of operation, i.e. after the apparatus had been unused for a while, it took a certain period of time before better results could be achieved. It must be assumed that the temperature of the inner wall of the apparatus was subjected to such great fluctuations after shutdown and during longer periods of use that this fluctuating result arose. Another factor was the often varying moisture content of the coal, and the varying content of volatile constituents and of ash of coal mixtures. The critical point was to vary the length of time the coal dust remained in the accelerator chamber. For this purpose also the present invention envisions a way whereby the heating of the wall of the accelerator chamber must be taken into consideration, namely with fixed gas or air nozzles in the wall of the chamber, as a result of which the length of time the coal dust remains in this chamber can be optimally adjusted. The ash removal at the front end of the accelerator chamber gives the necessary reference for this purpose.

An important factor for considering the present invention relative to the state of the art is that the flame which issues from the burner tube maintains its cylindrical or conical shape with the diameter in the cylindrical or conical accelerator chamber which it had as it issued from the burner tube. In this way there results between the periphery of the flame and the wall of the accelerator chamber, which has an enlarged diameter, a sleeve-like chamber in which can be effected the helical recirculation, against the front end of the device, of the ash and dust particles which are partially still unburned and which leave the combustion air flow due to centrifugal forces; these recirculating dust particles and ash directly surround the flame. At first, this helical return travel of the coal dust particles seemed difficult or even impossible to control in view of the high wall temperatures of the accelerator chamber. Movable parts such as adjustable nozzles brought no solution. In contrast, the rigid arrangement of the nozzles in the proposed manner provides a solution, which can also be used for continuous operation, which provides retention of the coal dust particles in the accelerator chamber. This means that a considerably greater portion of the coal dust is in actuality burned, and the proportion of unburned material in the ash is reduced.

It is known to liberate flue gases from undesirable gases or constituents by the use of additives. For example, lime can be added into the combustion chamber for desulfurization. The present invention offers the possibility of being able to add the additive in any desired quantity and in varying quantities over the length of the accelerator chamber, i.e. at the most favorable location and even in conjunction with the gas supplied by the nozzles.

DESCRIPTION OF PREFERRED EMBODIMENTS

Referring now to the drawings in detail, the inventive device illustrated comprises a conical burner tube 1 which widens from its front end 2 to its back end 3. The front end 2 is provided with twist means 4 in which the air for combustion, which is to be introduced via the conduit 5, is tangentially introduced into the tube 1, in which a helical twist flow 6 is imparted to the air.

Further means, such as the ignition means, etc., which are known, are not individually illustrated.

The longitudinal axis of a tubular blow lance 7 extends through the burner tube 1. The back end of the blow lance 7, i.e. in the vicinity of the back end 3 of the tube 1, is provided with a cap-like part 8 for reversing the direction of the delivery air for the pulverized coal, and the direction of the pulverized coal itself, in the blow lance 7 (see arrow *7a*), so that they exit the cap-like part 8 in the direction of the arrow 9. As a result, a circulating flow of the pulverized coal, and of the delivery air, results about the lance 7 in the direction of the arrow 10, with the outwardly disposed portion 10*a* of the flow being picked up and helically taken along by the flow 6 of the combustion air, while the remaining portion 10*b* flows along the lance 7 in the direction of the front tube end 2.

The air for combustion exits the tube 1 into an accelerator chamber 11, with the helical twist movement of the combustion air being maintained as an inner twist flow 12 along the solid line illustrated. The flame 13 is formed within this flow in the accelerator chamber 11; the flame 13 may, for example, extend into the subsequently arranged boiler room 14. In the illustrated embodiment, the accelerator chamber 11 has a conical shape, with the wall 16 thereof tapering from the front end to the back end 17. At the transition from the tube 1 to the accelerator chamber 11, the cross section of the chamber 11 is greater than the cross section of the back end 3 of the burner tube 1. As a result, not only an annular channel 18, but also a sleeve-like enlargement 19 of the accelerator chamber 11 are formed.

As shown in FIG. 1, when viewed in the longitudinal direction, the accelerator chamber 11 can be divided into successively disposed cross-sectional planes A to E, which can be spaced, equidistantly, or nearly equidistantly, from one another. Air or gas nozzles 20–27 are tangentially fixed in the wall 16 of the accelerator chamber 11; the arrangement of these nozzles will be explained in detail subsequently. Air or gas streams exit from the nozzles 26, 27 and 24, 25 of the cross-sectional planes D and E in the direction of twist or rotation of the inner twist flow 12 of the pulveried-coal-loaded combustion air, and generates, from the back end 17 of the accelerator chamber 11 to the back end 3 of the tube 1, a counter-running twist flow 28 when viewed in the longitudinal direction of the chamber 11. This outer twist flow 28, which results from the air or gas streams from the nozzles 24–27, is represented by a dot-dash line.

This additional twist flow takes place in the enlargement 19 of the accelerator chamber 11 without impairing the flame or the inner flow along the line 12 in the chamber 11. As a result, the dust and ash portions emerging from the inner twist flow 12 as a result of centrifugal forces can be carried along by the outer twist flow 28 along the enlargement 19 without difficulty to the annular channel 18, where the ash particles can be removed in the direction of the arrow 23. However, due to the radiant heat of the flame 13 in the accelerator chamber 11, the still unburned dust particles in the twist flow 28 are ignited and burned.

A portion of the coal dust or pulverized coal in the annular channel 18 is again picked up by the inner flow 12, since some of the coal dust strikes the wall 29 of the channel 18 and is thus directed into the interior of the tube 1 or even of the accelerator chamber 11. For this purpose, the wall 29 of the channel 18 which is adjacent the tube 1 is preferably curved or sloped in such a way that the coal dust particles are again guided out of the enlargement 19 into the interior of the tube 1 or of the accelerator chamber 11.

The twist flow 12 and the front end of the flame 13 maintain their shape in the accelerator 11 and do not increase in the enlargement 19, which as a result can be utilized for allowing the return of the dust and ash particles to take place along the wall 16 of the chamber 11.

The long back and forth travel which some of the dust particles repeatedly make in the tube 1 and in the accelerator chamber 11 assures that a short construction of the inventive device achieves a long combination path. In the accelerator chamber 11, the radiant heat of the already ignited coal particles acts on the not yet ignited dust particles not only on the way to the flame (from left to right in FIG. 1) but also on the return path (from right to left).

Both the length of the accelerator chamber 11 as well as its external shape can be varied. For example, the chamber 11 can be cylindrical, and its length can be such that the flame 13, which extends into the boiler room 14 of the boiler 15, can be longer or shorter.

As shown in FIG. 1, the nozzles 20–27 of the individual cross-sectional planes A to E of the accelerator chamber 11 are disposed at different inclinations relative to the cross-sectional planes. Thus, the nozzles 24–27 of the planes D and E are slightly inclined toward the front end and the annular channel 18 of the chamber 11. The nozzles of the plane C either have the same direction of inclination as do the nozzles 24–27 (see, for example, the nozzle 23), or they are not inclined at all relative to the cross-sectional plane C (see, for example, the nozzle 22). The nozzles 20 and 21 are inclined relative to their cross-sectional planes toward the back end 17 of the accelerator chamber 11. Not only can the angular position of the nozzles relative to the cross-sectional planes change from one plane to the next, but they can also change within a given cross-sectional plane, as shown in FIG. 1 with regard to the nozzles 22 and 23 of the plane C.

The number of nozzles can also vary from one cross-sectional plane to the next. Thus, as shown in FIG. 2, the plane D has a total of six nozzles **24-24*b* and 25-25*b*, while the plane B, as shown in FIG. 3, only has three nozzles 21, 31, 31*a***.

While FIg. 1 shows the various angles of inclination $\alpha \ldots \Omega$ of the nozzles relative to the planes, FIGS. 2 and 3 show that the angle between the nozzles and the corresponding tangents $T_2$ and $T_3$ of the wall 16 of the accelerator chamber 11 can also vary.

In the exemplary embodiment illustrated in FIG. 2, the supply lines 124 to **125*b* of the nozzles 24–25*b* are combined into two groups. The supply lines 124–124*b* open or merge into a conduit 224 having a valve 324, while the supply lines 125–125*b* open or merge into a common conduit 225 having a valve 325. Both conduits contain the gas or the air from a conduit 100**.

Feed lines 424, 524 having valves **424*a*, 524*a* empty into the conduit 224; these feed lines 424, 524 lead to respective tanks 101, 102, each of which contains an additive. A similar arrangement applies to the conduit 225 via the feed lines 425, 525, which are provided with the valves 425*a* and 525*a***.

FIG. 3 is intended to illustrate that an uneven number of nozzles of a given plane can be supplied with different additives.

The valves 324, 325 and **425*a* and 525*a* permit a precise adjustment of the quantity of gas, air, or additive which is being supplied. As a result, it is possible on the one hand to very precisely regulate the outer twist flow 28, i.e. to accelerate or retard it, in order to expose the dust particles of this flow to the radiant heat of the inner twist flow 12 for a longer or shorter period of time, and hence to burn as many coal dust particles as possible. On the other hand, it is also possible to introduce a desired quantity of additive into the chamber 11**. The additive, as is critical when additive is being added, is not supplied with the coal dust or the combustion air, but rather is added at a later point in time after the coal dust has already been ignited.

Due to the high wall temperature of the chamber 11, the nozzles 20–27 are preferably fixedly mounted in the wall. However, this does not preclude the nozzles from being supported in spherical parts which are pivotably disposed in spherical recesses.

The present invention is, of course, in no way restricted to the specific disclosure of the specification and drawings, but also encompasses any modifications within the scope of the appended claims.

What we claim is:

1. A combustion device, comprising:

a burner tube having a front end and a back end;

a blow lance which extends axially through said burner tube for supplying fuel thereto out of a discharge end of said blow lance located remote from said front end of said burner tube;

twist means disposed at said front end of said burner tube for imparting a twist to combustion air;

a cap-like part disposed at said discharge end of said blow lance for reversing, outside of the latter, the direction of flow of said fuel;

an accelerator chamber which communicates with said back end of said burner tube and is disposed in the axial direction of the latter; said accelerator chamber is provided with an outer wall having a diameter at the transition from said burner tube to said accelerator chamber which is greater than the diameter of said burner tube at this transition, so that said accelerator chamber has a shoulder at said transition, and also has an enlargement relative to said burner tube; and a plurality of nozzles disposed substantially tangentially in said outer wall of said accelerator chamber and in a plurality of cross-sectional plane which are disposed one after the other in the longitudinal direction of said accelerator chamber; said nozzles are adapted to supply, independently of one another, gas or air to said enlargement of said accelerator chamber while forming a twist flow in said enlargement.

2. A combustion device according to claim 1, which includes supply lines which lead to said nozzles, said supply lines being provided with valves for controlling the volume of at least one of said nozzles of a given cross-sectional plane.

3. A combustion device according to claim 2, which includes further supply lines which connect said nozzles with additive tanks, and are provided with quantity control valves.

4. A combustion device according to claim 3, in which said nozzles are disposed in said outer wall of said accelerator chamber at tangential angles which can vary from one cross-sectional plane to the next, and within a given cross-sectional plane, and selectively also at angles to said cross-sectional planes.

5. A combustion device according to claim 4, which includes at least one tangential ash-removal passage at said shoulder between said burner tube and said accelerator chamber.

* * * * *